US006866343B2

(12) United States Patent
Holl et al.

(10) Patent No.: US 6,866,343 B2
(45) Date of Patent: Mar. 15, 2005

(54) CHISEL HOLDER CHANGING SYSTEM WITH CHISEL HOLDER RECEIVERS

(75) Inventors: Bernd Holl, Neustadt (DE); Günter Hähn, Königswinter (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 10/320,336

(22) Filed: Dec. 16, 2002

(65) Prior Publication Data

US 2003/0132660 A1 Jul. 17, 2003

(30) Foreign Application Priority Data

Dec. 15, 2001 (DE) ..... 101 61 713

(51) Int. Cl.[7] ..... E21C 35/193; F16B 39/00
(52) U.S. Cl. ..... 299/102; 411/903; 411/914
(58) Field of Search ..... 299/102–103, 299/106–110; 411/82.2, 257, 258, 930, 901, 902, 903, 914, 916, 82.5

(56) References Cited

U.S. PATENT DOCUMENTS 3,498,677 A * 3/1970 Morrow ..... 299/102
3,983,304 A * 9/1976 Sekhon ..... 411/504
4,040,818 A * 8/1977 Clegg et al. ..... 75/310
4,642,011 A * 2/1987 Uramoto et al. ..... 411/258
4,802,807 A * 2/1989 Offenburger et al. .... 411/387.1
5,573,308 A * 11/1996 Simons et al. ..... 299/102

* cited by examiner

*Primary Examiner*—Sunil Singh
(74) *Attorney, Agent, or Firm*—Pauley Petersen & Erickson

(57) ABSTRACT

A chisel holder changing system having a base element with a chisel holder receiver, into which a chisel holder equipped with a chisel can be inserted, wherein the chisel holder is inserted with a holder shaft into the chisel holder receivers and is maintained therein with the aid of bracing screws. Bracing screws can be screwed into a threaded receiver of the base element and during this are supported under tension in a bracing receiver of the holder shaft of the chisel holder. If in a chisel holder changing system in accordance with this invention the surfaces of the outer screw thread of the bracing screw and/or of the inner screw thread of the threaded receivers of the chisel holder receivers have a metallic layer of zinc and aluminum lamellas and a mineral chromium oxide bonding agent, which is burned in after the application, the screw connections are improved so that larger prestressing forces/tightening torques can be transmitted without damage to the screw connections.

11 Claims, 1 Drawing Sheet

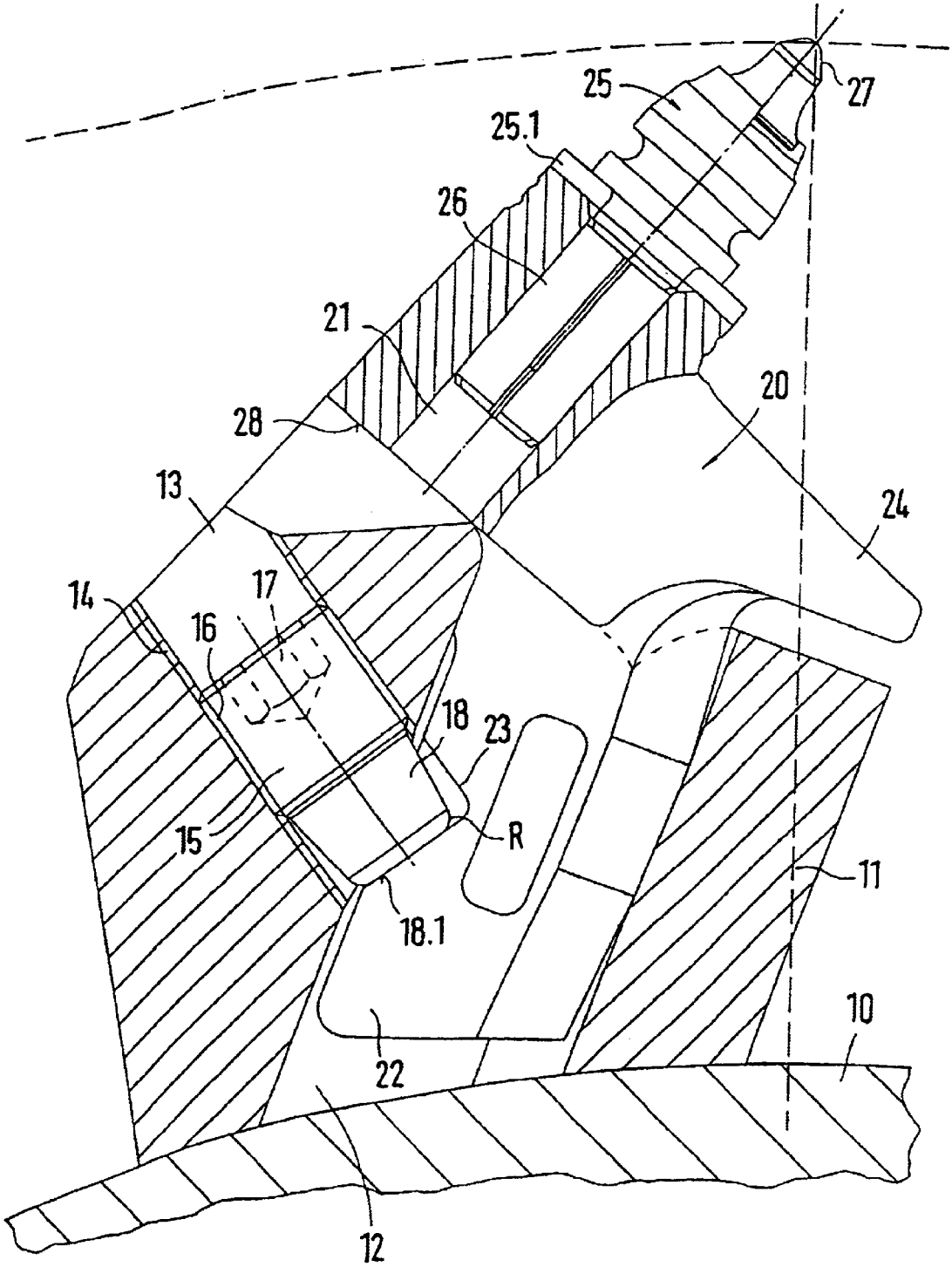
25
27
25.1
26
21
20
28
13
24
14
17
16
18
23
15
R
11
18.1
10
22
12

CHISEL HOLDER CHANGING SYSTEM WITH CHISEL HOLDER RECEIVERS

BACKGROUND OF THE INVENTION

1. Field of the Invention

This invention relates to a chisel holder changing system having a base element with a chisel holder receiver, into which a chisel holder equipped with a chisel can be inserted, wherein the chisel holder is inserted with a holder shaft into the chisel holder receivers and is maintained therein with bracing screws. The bracing screws can be screwed into a threaded receiver of the base element and during this are supported under tension in a bracing receiver of the holder shaft of the chisel holder.

2. Discussion of Related Art

Chisel holder changing systems are used with milling rollers of milling machines, for example road milling machines. The chisels in the chisel holders, as well as the chisel holders in the chisel holder receivers, can be changed, so that they can be replaced in case of wear, damage, and the like, without removing the chisel holder changing system from the milling machine.

For a definite seating of the chisel holder in the chisel holder receiver, the prestressing forces/tightening torques which can be adjusted by the bracing screws are important. If they are too great, the tool receivers of the bracing screws can become damaged, so that the release of the screw connection is difficult or even impossible. This then results in extensive repair work. Also, the sliding friction of the screw connection is large, so that the transmitted prestressing forces/tightening torques are greatly reduced.

SUMMARY OF THE INVENTION

It is one object of this invention to provide a simple screw connection between the bracing screw and the threaded receiver of the chisel holder receiver of a chisel holder changing system so that large prestressing forces/tightening torques can be transmitted to the holder shaft of the chisel holder without damaging the screw connection, which might impair the changing of the chisel holder.

In accordance with this invention, this object is achieved because the surfaces of the outer screw thread of the bracing screw and/or of the inner screw thread of the threaded receivers of the chisel holder receivers have a metallic layer of zinc and aluminum lamellas and a mineral chromium oxide bonding agent, which is burned in after the application.

Thus threaded portions of the screw connection are protected against corrosion by an electrochemical mechanism with the threaded elements made of steel, and they have a reduced coefficient of friction, so that an increased prestressing force/an increased tightening torque can be transmitted to the holder shaft of the chisel holder without damaging the tool receiver of the bracing screw, in particular. This layer is sacrificed instead of the base material and the consumption speed of the layer is controlled by the layer thickness.

In one embodiment, layer thicknesses between 5 $\mu$m and 10 $\mu$m are selected.

The barrier effect of the coated surfaces is increased by the number of lamellas per micrometer of the layer. The small thickness of the layer provides a problem-free coating of the threaded elements and the burn-in, which is performed at approximately 300° C. In contrast to an electrolytic application, coating without hydrogen embrittlement is achieved.

The layer can be applied by dipping, centrifuging or spraying processes and thereafter burned in.

Reducing the coefficient of friction of the screw connection by the addition of dry lubricants, it is possible to transmit even larger prestressing forces/tightening torques.

The same result can be achieved by increasing the layer thickness.

This coating is deposited in a non-electrolytic manner on the metallic base of the screw connection without impairing its ability to function. The coating is primarily of zinc and aluminum lamellas, which are formed in a metallic compound by chromium passivation, and it offers an optimal thin layer corrosion protection, to prevent seizing of the screw connection, even when the chisel holder changing system is used outdoors.

If the initial materials of the layer contain impurities, these are converted into carbon dioxide and water during the burning-in process. Therefore no poisonous residues are created either in the air or the water when the layer is applied, because no rinsing of the burned-in layer is required.

The zinc and aluminum lamellas of the metallic layer are bonded by metallic salts and chromium oxides with each other and with the metal base. The layer is formed by a chemical reaction between the layer material and the metal base during the burning-in process at approximately 300° C. The layer material is available in a dispersion of zinc and aluminum lamellas in an aqueous chromic acid solution. The dispersion contains only small amounts of organic substances, which are required for controlling the chemical reaction.

The burning-in process is an important part in the application of the layer. The hexavalent chromium contained in the dispersion is reduced by the effects of the heat to insoluble and non-poisonous trivalent chromium in accordance with the following reaction:

$$2ZnCr_2O_7 \rightarrow 2ZnCr_2O_4 + 3O_2.$$

These chromium salts envelop each metallic lamella, as well as the metal base. The cohesion of the layer and the formation of a corrosion-resistant layer is thus possible.

To attain the object of this invention, the bracing screw has a shoulder, which rests against the bracing receiver with a contact surface, and the shoulder has lesser outer cross-sectional dimensions, at least in the area following the contact surface, than the outer diameter of the outer screw thread of the bracing screw.

The shoulder with tapering cross section further reduces the danger of damage to the threaded connection. If during operation a flattening of the contact surface occurs because of the arising bracing and work forces, this does not impair the easy disassembling ability. The shoulder can be freely turned out of the threaded receiver of the chisel holder without damage to the screw threads occurring.

For optimal layout for sturdiness, the shoulder is embodied in the shape of a truncated cone and continuously tapers, starting from the area of the bracing screw with the outer screw thread toward the contact surface.

In a further embodiment of this invention, the bracing screw is designed as a stud screw and is screwed completely into the threaded receiver of the base element. With this the bracing screw is completely removed from the closing area.

BRIEF DESCRIPTION OF THE DRAWINGS

This invention is explained in greater detail in view of an exemplary embodiment represented in the drawings, wherein the single drawing FIGURE shows a chisel holder changing system in a sectional lateral view.

DESCRIPTION OF PREFERRED EMBODIMENTS

The chisel holder changing system of this invention comprises a base element 11 and a chisel holder 20. The base element 11 is fastened on the surface of a milling roller 10, preferably welded on it. The base element 11 has a chisel holder receiver 12. The chisel holder 20 is inserted into the chisel holder receiver 12 with a holder shaft 22. The holder shaft 22 has a cut in a bracing receiver 23. The bracing receiver 23 is accessible via a threaded receiver 13. The threaded receiver 13 is cut into the base element 11. A bracing screw 15 is used for fixing the chisel holder 20 in place on the base element 11. The bracing screw 15 is designed as a stud screw and has a tool receiver 17 (hexagon socket) in its head. The bracing screw 15 is screwed into the inner screw thread 14 of the threaded receiver 13 with its outer screw thread 16. The bracing screw 15 has a shoulder 18 on its end facing away from the tool receiver 17. The shoulder 18 is embodied as a truncated cone and continuously tapers, starting from the area of the outer screw thread 16 of the bracing screw 15 toward the free end of the bracing screw 15. The shoulder 18 terminates in a contact surface 18.1. The contact surface 18.1 is supported on a countersurface of the bracing receiver 23.

The inserted chisel holder is supported on the base element 11 with its abutting surface 28. As the drawings show, a bore embodied as a chisel receiver 21 terminates in this abutting end. The chisel receiver 21 receives a round shaft chisel 25. The round shaft chisel 25 has a chisel head, on which a chisel shaft is formed. A bracing sleeve 26 is drawn on the chisel shaft and is braced in a spring-resilient manner on the chisel receiver 21 and fixes the round shaft chisel 25 in place. The chisel head is supported on the top of the chisel holder via a wear-protection disk 25.1. The chisel head has a hard alloy tip 27. For fixing the chisel holder 20 in place on the base element 11, the bracing screw 15 is braced against the bracing receiver 23, as described above. Large prestressing forces are required for this purpose. To be able to increase the friction between the outer screw thread 16 of the bracing screw 15 and the inner screw thread 14 of the threaded receiver 13, a metallic layer of zinc and aluminum lamellas and a mineral chromium oxide bonding agent are applied to the outer screw thread 16. After having been applied, this layer is burned in. Further than that, this layer also provides corrosion protection.

Because of the large bracing force, large surface pressures are generated in the transition area between the contact surface 18.1 and the bracing receiver 23. These forces can lead to a flattening of the shoulder 18, in particular if it is also necessary to absorb large impact forces via the chisel 25 during operations. Because the geometry of the shoulder 18 is selected to be tapering, the occurring flattening is harmless to a certain extent, and does not damage the inner screw thread 14, particularly when turning the bracing screw 15 out of the threaded receiver 13.

What is claimed is:

1. In a chisel holder changing system having a base element with a chisel holder receiver, into which a chisel holder equipped with a chisel is insertable, wherein a holder shaft of the chisel holder is inserted into the chisel holder receiver and is maintained within the chisel holder receiver with a bracing screw, and wherein the bracing screw can be screwed into a threaded receiver of the base element while being supported under tension in a bracing receiver of the holder shaft of the chisel holder, the improvement comprising:

a surface of at least one of an outer screw thread (16) of the bracing screw (15) and an inner screw thread (14) of the threaded receiver (13) of the chisel holder receiver (11) having a metallic layer of zinc and aluminum lamellas and a mineral chromium oxide bonding agent which is burned in after being applied;

wherein the metallic layer is applied by at least one of a dipping process, a centrifuging process and a spraying process, is dried thereafter and is finally burned in at approximately 300° C.

2. In the chisel holder changing system in accordance with claim 1, wherein the metallic layer has a thickness between 5 $\mu$m and 10 $\mu$m.

3. In the chisel holder changing system in accordance with claim 2, wherein a barrier effect of the coated surface is increased with a number of lamellas per $\mu$m of the layer.

4. In the chisel holder changing system in accordance with claim 3, wherein one of a prestressing force and a tightening torque of a screw connection between the bracing screw (15) and the threaded receiver (13) of the chisel holder receiver (11) is increased by increasing a thickness of the metallic layer.

5. In the chisel holder changing system in accordance with claim 4, wherein a coefficient of friction of the screw connection is reduced by an addition of dry lubricants.

6. In the chisel holder changing system in accordance with claim 1, wherein a barrier effect of the coated surface is increased with a number of lamellas per $\mu$m of the layer.

7. In the chisel holder changing system in accordance with claim 1, wherein one of a prestressing force and a tightening torque of a screw connection between the bracing screw (15) and the threaded receiver (13) of the chisel holder receiver (11) is increased by increasing a thickness of the metallic layer.

8. In the chisel holder changing system in accordance with claim 1, wherein a coefficient of friction of a screw connection between the bracing screw (15) and the threaded receiver (13) is reduced by an addition of dry lubricants.

9. In the chisel holder changing system in accordance with claim 1, wherein the bracing screw (15) includes a shoulder (18) shaped as a truncated cone and that continuously tapers, starting from near the bracing screw (15) with the outer screw thread (16) and directed toward a contact surface (18.1).

10. In the chisel holder changing system in accordance with claim 9, wherein the shoulder (18) transitions into the contact surface (18.1) over a radius (R).

11. In the chisel holder changing system in accordance with claim 1, wherein the bracing screw (15) is a stud screw and is screwed completely into the threaded receiver (14) of the base element (11).

* * * * *